US005337838A

United States Patent [19]

Sorensen

[11] Patent Number: 5,337,838

[45] Date of Patent: Aug. 16, 1994

[54] METHOD AND AN APPARATUS FOR TAKING AND ANALYZING LEVEL DETERMINED SAMPLES OF PORE GAS/LIQUID FROM A SUBTERRANEAN FORMATION

[76] Inventor: Kurt I. Sorensen, Blegindvej 102, DK-8362 Horning, Denmark

[21] Appl. No.: 988,952

[22] PCT Filed: Sep. 18, 1991

[86] PCT No.: PCT/DK91/00277

§ 371 Date: Mar. 23, 1992

§ 102(e) Date: Mar. 23, 1992

[87] PCT Pub. No.: WO92/05338

PCT Pub. Date: Apr. 2, 1992

[30] Foreign Application Priority Data

Sep. 19, 1990 [DK] Denmark ..... 2252/90

[51] Int. Cl.[5] ..... E21B 49/08

[52] U.S. Cl. ..... 175/59; 73/155; 166/264; 175/309

[58] Field of Search ..... 175/59, 58, 308, 309; 166/264; 73/155

[56] References Cited

U.S. PATENT DOCUMENTS

| | | | |
|---|---|---|---|
| 3,079,793 | 3/1963 | Le Bus et al. | 166/264 X |
| 3,441,095 | 4/1969 | Youmans | 175/59 |
| 4,363,366 | 12/1982 | Hilty | 175/314 |
| 4,669,554 | 6/1987 | Cordry | 175/59 |
| 4,804,050 | 2/1989 | Kerfoot | 175/59 X |
| 4,807,707 | 2/1989 | Handley | 175/20 |
| 4,912,415 | 3/1990 | Sorensen | 175/323 X |
| 5,137,086 | 8/1992 | Stokley et al. | 166/264 |
| 5,146,988 | 9/1992 | Cordry et al. | 175/59 X |

FOREIGN PATENT DOCUMENTS

| | | | |
|---|---|---|---|
| 910292 | 9/1972 | Canada | 175/59 |
| 197712 | 12/1977 | U.S.S.R. | 73/155 |

*Primary Examiner*—Hoang C. Dang
*Attorney, Agent, or Firm*—Ladas & Parry

[57] ABSTRACT

A method and an apparatus serve to take and analyze level determined samples of pore gas/liquid, e.g. water from a subterranean formation, in which a borehole is drilled and pore gas/liquid samples are conveyed at a desired depth into a cavity in the drill string(1). The samples are analyzed in two steps, where they are first analyzed in a sample chamber (18) which is detachably mounted in the drill string during drilling, and which contains a plurality of probes for in situ analysis of the samples and transmission of the analysis results to the surface of the ground where they are recorded. The samples themselves are then pumped up to the surface of the ground by means of a pump assembly (20). The samples are now analyzed at the surface of the ground for further components, e.g. organic and toxic substances, just as the in situ analyses in the sample chamber are repeated at the surface of the ground. These analysis results are corrected by comparison between corresponding samples in the sample chamber and on the surface of the ground.

15 Claims, 4 Drawing Sheets

METHOD AND AN APPARATUS FOR TAKING AND ANALYZING LEVEL DETERMINED SAMPLES OF PORE GAS/LIQUID FROM A SUBTERRANEAN FORMATION

FIELD OF THE INVENTION

The invention concerns a method of taking and analysing level determined pore gas/liquid samples, e.g. water from a subterranean formation, comprising drilling a hole in said formation and passing samples at a desired depth into a cavity in the drill string used for the drilling, following which the samples are analysed.

BACKGROUND OF THE INVENTION

Contamination from chemical depots, agriculture and other sources of contamination has led to an increasing need of rapidly and exactly mapping the chemical conditions in a subterranean formation and e.g. ascertaining whether the water in its water deposits can be used as drinking water. Over time various methods and devices have been developed for this purpose, which, however, are either slow or cumbersome to use or give analysis results which are not sufficiently reliable.

Thus, the U.S. Pat. No. 4,363,366 proposes the use of a hollow auger bit having in one or more of the sections of the drill string a plurality of about 0.3 mm narrow slots, through which pore gas/liquid from the formation can enter the cavity of the string and be pumped or sucked via this up to the surface of the ground where the samples are analysed. However, before this takes place the samples have been in direct contact with the atmospheric air in the open cavity of the string, whereby i.a. the oxygen of the air affects the samples, which are moreover subjected to a pressure drop causing their content of carbon dioxide to degas. To this should be added that the samples are also easily contaminated by oil and packer material from the joints of the drill string, and these factors in combination will change the chemistry of the samples to such a degree that the achieved analysis results will not give a true picture of the chemical conditions in the formation concerned. Another problem is that very narrow slots must necessarily be used to prevent the drill string from being filled with mud, but this entails in turn that the slots will easily clog so that the process ceases operating when the auger bit has reached a distance down into the formation. The bit must therefore frequently be pulled up for cleaning of the slots, and this greatly delays and impedes the work and adds to the costs involved.

The U.S. Pat. No. 4,669,554 discloses another method which is so designed that it is possible to convey undisturbed pore gas/liquid samples to the surface of the ground to obtain true analysis results. In this case a ram with a sample chamber is driven down into the ground, and then a pore gas/liquid sample is collected in the sample chamber, which is subsequently sealed with respect to the surroundings, and the sample is conveyed up to the surface of the ground, the ram with the sample chamber being pulled out of the formation. The samples are hereby representative of the pore gas/liqud of the formation whose chemical conditions can therefore be determined correctly. However, only one sample at a time can be taken in this manner, and the process is therefore both slow and expensive and is in reality inapplicable when the chemical conditions of a subterranean formation is to be plotted with a greater vertical resolution within a reasonable period of time.

SUMMARY OF THE INVENTION

The object of the invention is to provide a method of the type stated in the opening paragraph which can take level determined pore gas/liquid samples from a subterranean formation at short intervals and more rapidly and easily than known before to give true analysis results by means of these samples, and which can moreover currently monitor the formation at a desired depth.

This is achieved in that the method of the invention characterized by dry drilling the borehole by means of a hollow earth bit, e.g. a hollow auger bit, isolating the drill string in the vicinity of the tip of the drill a cavity section in sealed relationship with the rest of the cavity of the string, said cavity section having a sample chamber which communicates with the isolated cavity section e.g. via a filter, providing a plurality of inlet openings in the drill string wall substantially radially opposite the sample chamber to direct pore gas/liquid samples into the sample chamber where the samples are analysed in situ by means of probes for e.g. electric conductivity, acidity (pH), redox potential (Eh), oxygen content, pressure, ion content, ect., the analysis results the form of e.g. electric signals being transmitted to the surface of the ground for recording, and then pumping the respective sample itself up to the ground surface by means of a pump assembly where the same analysis as in the sample chamber is repeated wholly or partly and is Supplemented with an additional analysis of the sample content of e.g. organic and toxic components, following which the results of the last-mentioned analyses are corrected in response to any deviations between the in situ analysis results from the sample chamber and the corresponding analysis results on the surface of the ground. The samples are thus taken close to the bit tip where the pore gas/ liquid has not yet been influenced by the drilling process, and since the samples are then collected in a cavity, they are not, like in the conventional methods, subjected to chemical changes which are caused e.g. by the influence of the air, and to pressure drop in the samples. This entails that the analysis results in the sample chamber are true and can therefore be used for correcting the analysis results which are later obtained at the surface of the ground, so that the total analysis results are true. The samples can be taken while the earth bit operates, and the process is therefore very rapid and can moreover be repeated at short intervals, so that a very great resolution of the vertical structure of the formation can be obtained.

With a view to currently monitoring the formation at a desired depth, the method of the invention may moreover be designed such that the sample chamber is detachably mounted in the drill string in such a manner that a string cavity section positioned around the chamber is isolated in sealed relationship with the rest of the cavity, that the sample chamber is removed from the drill string when this has reached a desired depth, that the string is opened downwardly e.g. by knocking out the tip, that at least one monitoring pipe is lowered through the cavity now extending freely through the string, that the string is pulled out of the borehole and that the pore gas/liquid in the formation is currently monitored at the lower end part of the monitoring pipe.

Moreover, according to the invention, to prevent the process from coming to a standstill because the inlet openings are cloged when drilling through clayly and silty layers, a liquid, e.g. water, or a gas, e.g. nitrogen, may temporarily be passed through the inlet openings in the drill string wall via a pipe or hose connection under the action of a pressure which exceeds the pore gas/liquid pressure in the formation layer to which the drill string has reached, so that the inlet openings are cleaned.

The invention also concerns an apparatus for performing the above-mentioned method, and this apparatus is characterized according to the invention in that it comprises an earth bit, e.g. an auger bit with a cavity extending axially therethrough and being downwardly closed with a detachably mounted tip, the wall of said cavity being formed with a plurality of inlet openings, e.g. vertical slots, in the vicinity of the tip through which pore gas/liquid can enter the cavity; a sample chamber which is detachably mounted in the cavity and which isolates at any rate a cavity section opposite the inlet openings in sealed relationship with the rest of the cavity and communicates with the isolated cavity section preferably via a filter: a plurality of probes which are positioned in the sample chamber and which serve to analyse pore gas/liquid samples in it in situ and to transmit the analysis results via electric wires to the surface of the ground for recording there; and a pump assembly for then pumping the samples up to the surface of the ground from the sample chamber while said chamber is in the mounted state. This entails that an analysis of a sample can be performed in two steps, the first one taking place in situ in the sample chamber where the sample is still in an undisturbed state and the obtained sample results are therefore true, the second step taking place at the surface of the ground with a more comprehensive analysis of the sample which must now be expected to have gone through certain chemical changes, but with the possibility of correcting the analysis results by comparison with the analysis results from the first step so that the total analysis results are true.

To ensure that the sample chamber is just filled with clean pore gas/liquid, the isolated cavity section may be filled with a filter material, such as sand.

The sample chamber is detachably secured in the cavity of the drill string and isolates in sealed manner a section of said cavity around the chamber, an elastomeric hose being clamped around the sample chamber and/or an extension of it, said elastomeric hose being inflatable, via a tube or hose connection with a valve which can be activated from the surface of the ground, with air or liquid such that the elastomeric hose is stretched tightly against the inner side of the drill string, said drill string cavity having a constriction which begins immediately above the inflated upper part of the elastomeric hose, so that the pressure in the formation cannot displace the chamber vertically upwardly in the drill string.

In another embodiment the sample chamber is retained detachably in the cavity of the drill string, said sample chamber being mounted in a constriction in the cavity which, at this point, has a diameter corresponding to the diameter of the chamber and at least one gasket, which is positioned in a groove in the inner wall of the string and serves to seal the isolated cavity section with respect to the rest of the cavity, said chamber, in the mounted state, being kept axially locked in the drill string by means of a swing pawl engaging a notch or a recess in the inner wall of the drill string, so that nor in this case can the pressure in the formation displace the chamber vertically upwardly in the drill string.

When the first step of the analysis has taken place in the sample chamber, the sample is pumped by means of a pump to the surface of the ground where the next step takes place. In a particularly advantageous embodiment this pump is so arranged that a separate pump chamber is provided preferably in elongation of the sample chamber, said pump chamber being connected with the sample chamber via a nonreturn valve permitting a pore gas/liquid sample to pass from the sample chamber to the pump chamber, but not conversely, said pump chamber being moreover connected with the surface of the ground by means of two pipe or hose connections, one of which serves to convey a gas, e.g. air or nitrogen under pressure into the pump chamber upon pumping, and the other serves to convey the displaced pore gas/liquid from the pump chamber up to the surface of the ground.

According to the invention, with a view to temporarily cleaning the inlet openings which may be clogged by solid components in the formation in particular when drilling through clayly and silty layers, the sample chamber may be connected with the surface of the ground by means of a pipe or hose connection having inserted therein a non-return valve which prevents passage of the pore gas/liquid samples through the connection, which may be connected, via a valve at the surface of the ground, with a source of pressure liquid or pressure gas which, upon activation of the valve, feeds liquid or gas to the sample chamber under the action of a pressure which exceeds the pore gas/liquid pressure in the formation layer to which the drill string has reached. The inlet openings can hereby be blown clean by means of e.g. nitrogen under pressure to provide the advantage that the process can proceed continuously without it being necessary to pull up the drill string for cleaning the inlet openings like in the conventional devices.

According to the invention the apparatus may also comprise at least one monitoring pipe which, after removal of the sample chamber and the pump assembly, is lowered through the cavity of the drill string to provide a permanent connection with the pore gas/liquid in a desired formation layer instead of the earth bit which is pulled out of the borehole. The formation layer at the depth concerned can then be monitored currently.

BRIEF DESCRIPTION OF THE DRAWING

The invention will be explained more fully by the following description of embodiments which exclusively serve as examples, with reference to the drawing, in which.

DETAILED DESCRIPTION OF PREFERRED EMBODIMENT

Figure 1:
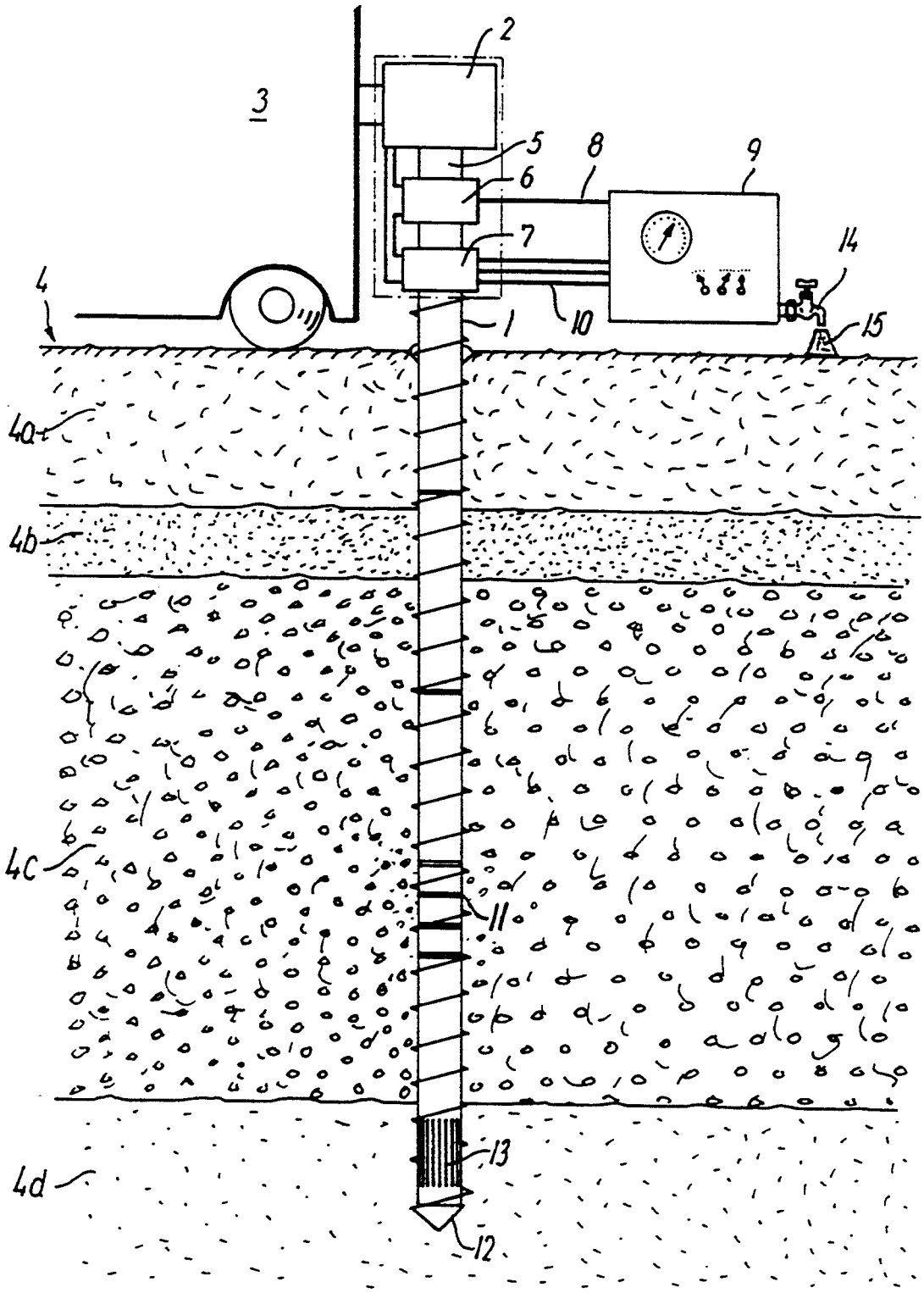
FIG. 1 is a schematic view of an apparatus according to the invention in the form of an auger bit which is being drilled down into a subterranean formation.

FIG. 1 schematically shows a drilling arrangement for performing the method of the invention, using an auger bit 1 which is drilled down into a subterranean formation 4 consisting of several layers 4*a–d* by means of a vertically slidable drilling machine 2 which is mounted on a mobile drilling rig 3. A dry drilling technique is used for the drilling, which excludes contamination of the samples by drilling mud. The drilling machine 2 transmits its rotary motion to the auger bit 1 via a power transmission shaft 5 which extends through a shoe assembly 6 and further down through a water/air sluice 7, and is then connected with the auger bit 1. A cable connection 8 is run from the shoe assembly 6 to an instrument and control unit 9, which is moreover connected with the water/air sluice 7 by means of hose connections 10 whose importance will be explained more fully below.

The drill string is moreover provided with an electrically logging probe 11 of the type described in the applicant's U.S. Pat. No. 4,912,415 issued on Mar. 27, 1990. During sampling, this electrically logging probe serves to determine the geology of the drilled layers to currently provide information on the type of the layers from which the pore gas/liquid samples are obtained, said information being of significant importance in the examination of e.g. the quality of water deposits it being noted that a contamination in loose sand may be much more dangerous than in silt. Thus, if a contamination is found during sampling, it is possible to evaluate how dangerous this contamination is on the basis of the knowledge of the type of the layer from which the sample originates.

As additionally shown by FIG. 1, the auger bit 1 downwardly has a conical tip 12 and a plurality of vertical slots 13 to receive pore gas/liquid samples. The instrument and control unit 9 is moreover provided with a tap 14 for tapping samples into a container 15, in which the samples can be transported to a laboratory for quantitative analysis for various components. The tapping is shown in principle in the figure, but preferably takes place in practice in a closed system (not shown) to prevent the samples from being influenced by contact with the atmospheric air.

Figure 2:
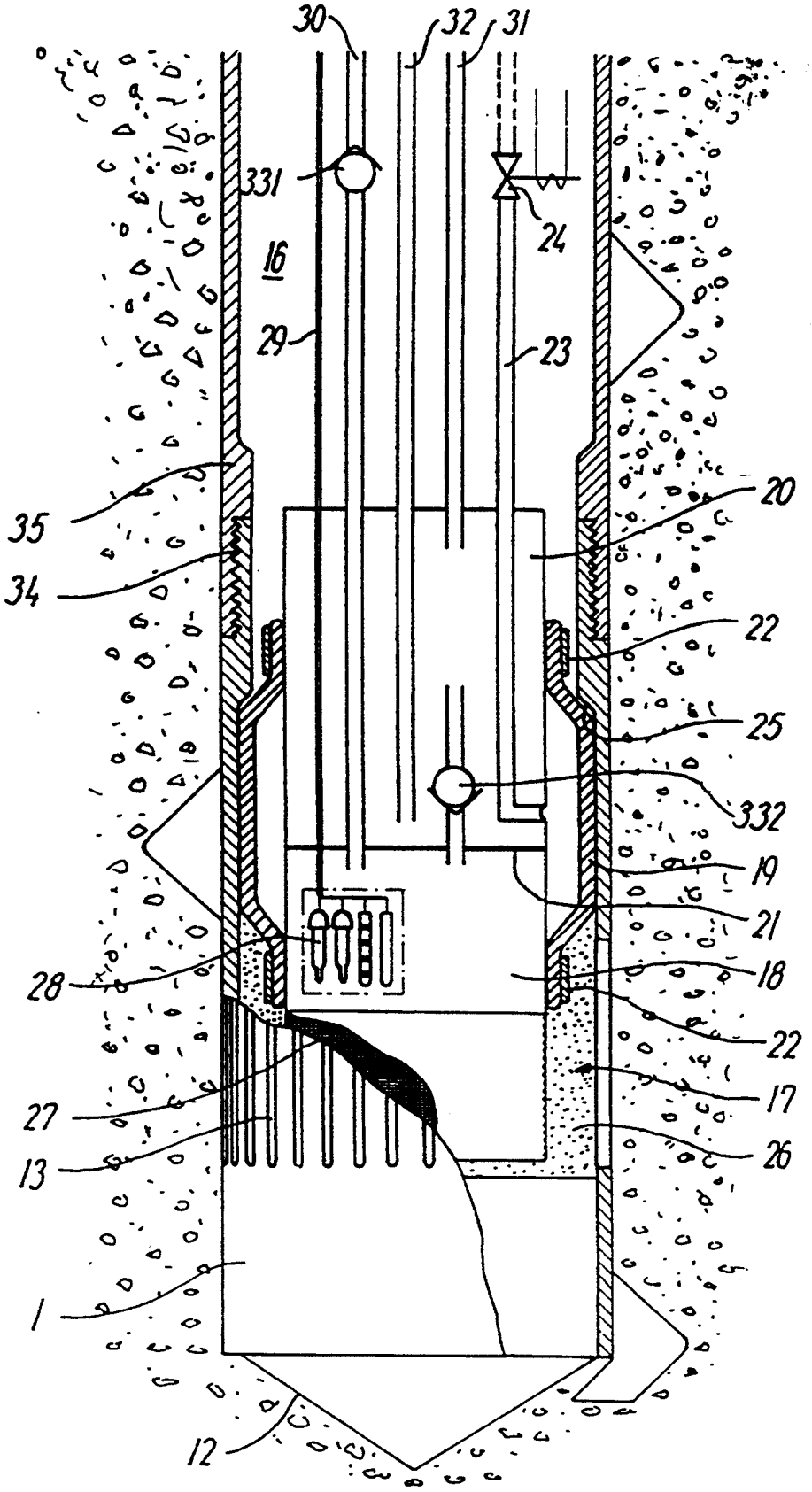
FIG. 2 is a partially sectional view on an enlarged scale of a fraction of the lower end part of the auger bit shown in FIG. 1.

FIG. 2 now shows the lower end part of the hollow auger bit 1 shown in FIG. 1 with the tip 12 and the vertical slot 13, so that, as far as possible, the samples taken from the formation are not disturbed by the actual drilling process. As previously mentioned, the auger bit is hollow and has a cavity 16 extending axially all the way through the drill string. At the level of the slots 13, the cavity 16 detachably accommodates a sample chamber 18 which has an extension 20 separated from the sample chamber by a partition 21. An elastomeric hose 19 is clamped tightly around the sample chamber 18 and its extension 20 with clamping ties 22. Via a connection 23 with an inserted magnetic valve 24 the hose 19 is connected with a pressure source (not shown) with e.g. water under pressure at the surface of the ground. When the valve 24 is activated, the hose 19 is inflated and thereby stretched tightly against the inner wall of the drill string, which has an internal shoulder 25 immediately above the inflated part of the hose to prevent the overall sample chamber arrangement from being pressed vertically upwardly in the drill string by the pressure in the formation.

This clamping of the sample chamber seals off a cavity section 17 which is filled with a filter material 26, e.g. sand. Further, a fine mesh filter cloth 27 is applied around openings in the sample chamber, the chamber communicating through said cloth with the cavity section 17. A plurality of probes 28 are arranged inside the sample chamber, each of said probes being capable of measuring a specific property of the properties of a pore gas/liquid sample, which are then transmitted via electric wires 29 and the cable connection 8 to the instrument and control unit 9 which collects and records the measured results. Further, via a line 30 with a non-return valve 332 the sample chamber 18 can be connected with a pressure source (not shown) with e.g. nitrogen at the surface of the ground, and it communicates with the sample chamber extension 20 via a non-return valve 331. The sample chamber extension 20 is connected with the surface of the ground via an air line 31 and a liquid line 32, respectively, which are connected via the water/air sluice 7 and the pipe or hose connections 10 with the instrument and control unit 9.

When the chemical conditions in a subterranean formation are to be mapped vertically at predetermined intervals, the auger bit 1, as previously described, is drilled down into the formation, one section after the other being successively screwed on during this process by means of threaded joints 34. The electric wires are simultaneously connected to the electrically logging probe and the probes in the sample chamber, and this can advantageously take place with relatively inexpensive plugs since these do not have to be of a watertight design, the cavity of the drill string being dry above the sample chamber which keeps the cavity section 17 separated in watertight manner from the rest of the cavity 16 of the drill string. During drilling, information on the type of drilled layers is currently provided by means of the electrically logging probe 11 (FIG. 1), so that it is possible to evaluate the dangerousness of a possibly observed water contamination.

A pore gas/liquid sample is conveyed through the slots into the cavity section 17 for each sample interval, the sample penetrating further inwardly via the filter sand 26 and the filter cloth 27 to fill the sample chamber 18. The sample, from which solid components from the formation have essentially been filtered off, is now analyzed in the sample chamber by means of the probes 28 for a number of properties, such as electric conductivity, acidity (pH), redox potential (Eh), oxygen content, pressure, ion content, ect. Since the sample chamber is completely sealed off with respect to the atmospheric air and is under the same pressure as in the surrounding formation, the sample is not disturbed by external forces and is thus representative of the pore gas/liquid in the formation. The achieved analysis results, which are therefore true, are transmitted via the electric wires 29 and the shoe assembly 6 up to the instrument and control unit 9, where the results are collected and recorded.

Then air is pumped from a compressed air source (not shown) at the surface of the ground down through the line 31 to the sample chamber extension 20, whereby its content of water is displaced up through the liquid line 32 and further on from this via the water/air sluice 7 to the instrument and control unit 9, the non-return valve 331 blocking backflow of the liquid to the sample chamber 18.

At the surface of the ground the sample, which is now undisturbed by external impacts from e.g. the oxygen of the air and the often considerable pressure difference between the pressure at the surface of the ground and the pressure in the respective formation depth, is subjected to an additional analysis, which can be performed with ion specific electrodes, which it is not possible to fit in the sample chamber, or with a spectrograph or chromatograph, just as the sample may be sent for analysis at a laboratory, the sample being taken in a closed system where it does not contact atmospheric air. In this manner it is possible to take specific measurements of properties which are important for the quality of the water, such as organic and toxic compounds. However, these analysis results will not be true since the sample is disturbed as mentioned, and the results are therefore corrected by a comparison with the already recorded results from the in situ analyses in the sample chamber, so that the final, total analysis result will be true.

When the pressure in the air line 31 is relieved, a new pore gas/liquid sample penetrates into the sample chamber 18 and its extension 20, following which the working cycle described above is repeated, and, as will be appreciated, this may take place at short intervals and without interrupting the drilling process, whereby the formation can be examined currently and even thin horizons with perculate or the position of a contamination front, e.g. a nitrate front can be detected with greater accuracy and more rapidly and easily than known before.

Figure 3:
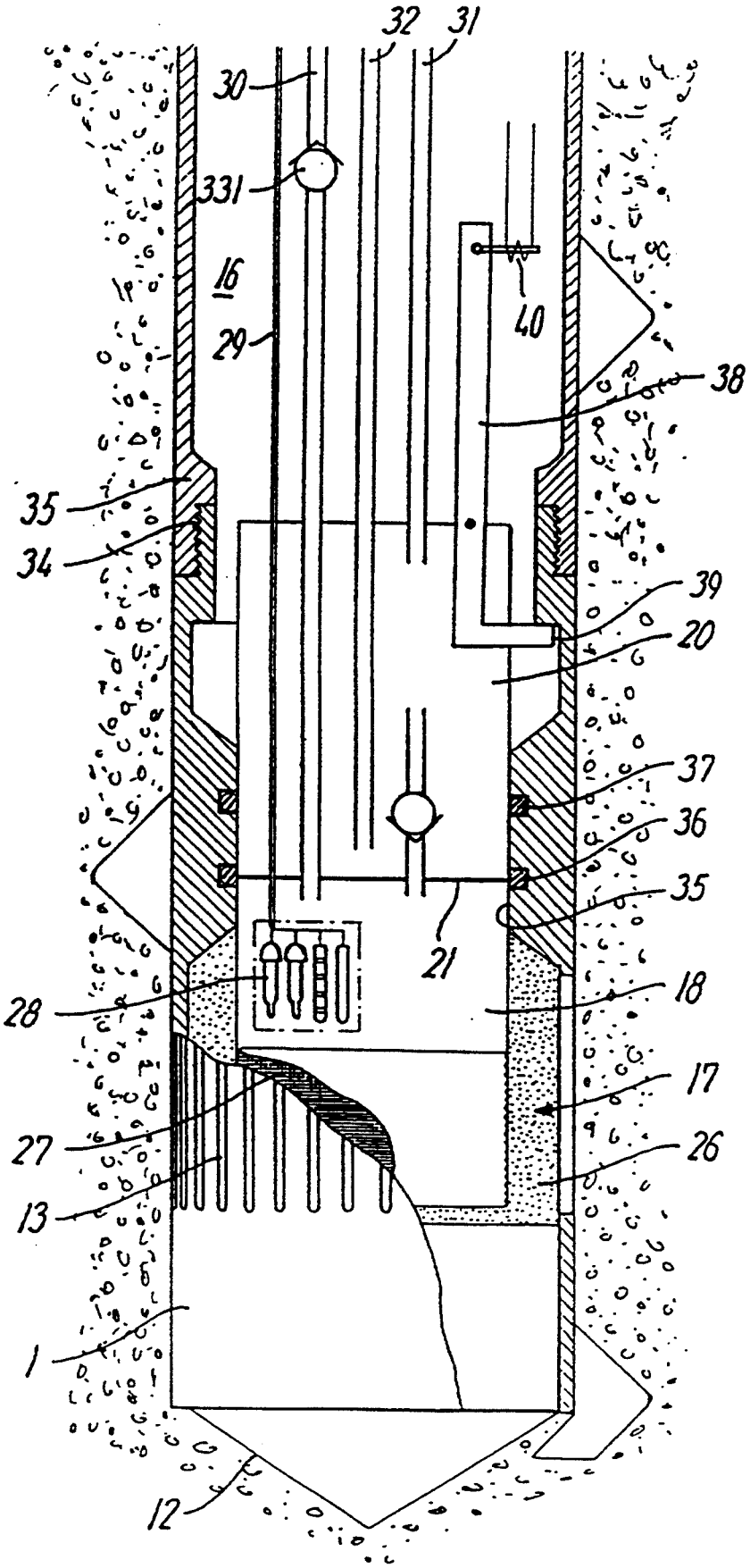
FIG. 3 shows the same, but in another embodiment.

The embodiment shown in FIG. 3 corresponds to the one shown in FIG. 2 and described above in all respects, except that the sample chamber 18 with the extension 20 is detachably mounted in another manner in the cavity 16 of the drill string. In this case, the sample chamber 18 with the extension 20 is mounted axially slidably in a constriction 35, which is provided in the drill string cavity 16 and has annular grooves 37 with 0-rings 30 for sealing off the cavity section 17 with respect to the rest of the drill string cavity 16. The sample chamber and its extension are locked against axially upward displacement in the drill string cavity by the pressure in the formation by means of a swing pawl, 38 which, in the locked state, engages an annular recess 39 formed in the inner wall of the drill string. A magnetic valve 40 or similar activation means serves to engage and disengage the swing pawl from the recess By means of the method and the apparatus described above it is, as mentioned, now possible to obtain true information on both the chemical conditions at a specific formation depth and on the geological nature of the formation at this point at short intervals during the actual drilling process, thereby enabling optimum selection of the filter levels where it may be interesting to monitor the formation currently.

Figures 4A, 4B, 4C, 4D, 4E, 4F:
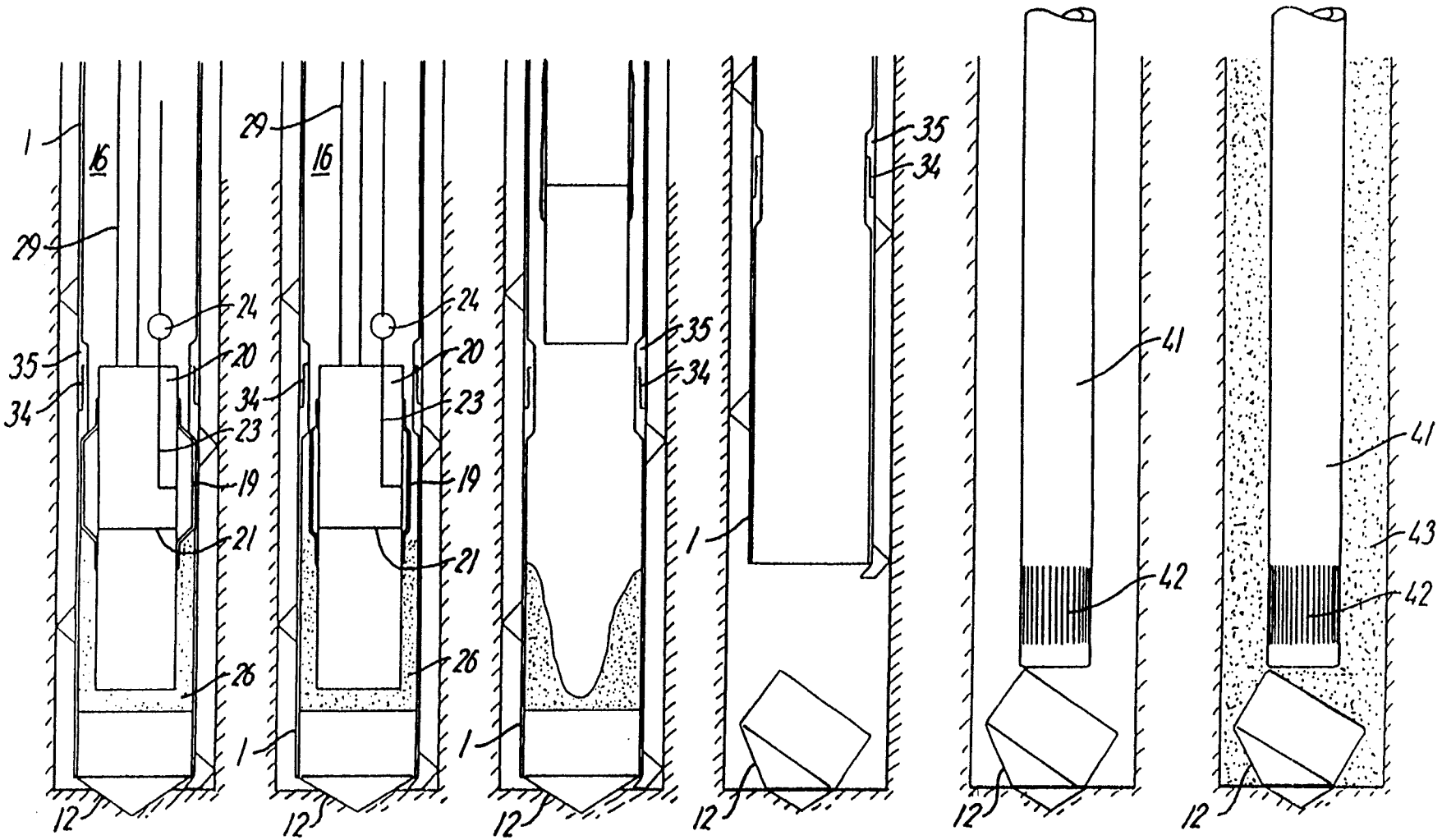
FIGS. 4*a*–4*f* shows successive process steps in the mounting of a monitoring pipe for current monitoring of the formation.

FIGS. 4*a–f* show successively how a monitoring pipe 41 is placed in the formation when the auger bit 1, as shown in FIG. 4*a*, has reached the vertical depth where the formation is to be monitored. Upon activation of the magnetic valve 24, the pressure is relieved in the elastomeric hose 19, which hereby contracts and releases the sample chamber 18 and its extension 20 (FIG. 4*b*). In FIG. 4*c* the sample chamber and its extension are now being pulled up through the drill string cavity 16, so that the sand filter 26; as shown, collapses loosely. Then the drill string is pulled slightly upwardly, and the detachably mounted conical tip 12 is knocked out by means of e.g. a drop hamer (not shown), whereby the situation is as shown in FIG. 4*d*. Finally, the drill string is pulled back with simultaneous afterfilling with e.g. bentonite to seal off the various layers of the formation with respect to each other, so as to prevent pore gas/-liquid from the various formation layers from merging. The pore gas/liquid from the selected filter level now penetrates from the formation via slots 42 into the monitoring pipe 41 and is conveyed through this to the surface of the ground for further continuous examination and/or use.

I claim:

1. In a method of taking an analyzing level determined pore gas or liquid samples from a subterranean formation, wherein the method comprises drilling a borehole in said formation, passing samples at a desired depth into a cavity in a drill string used for the drilling, and analyzing the samples, the improvement comprising a) dry drilling the borehole by means of a hollow earth bit comprising an inlet opening or openings so as to cause a sample to be analyzed to enter a first cavity section of a bit near a tip thereof and to pass into a sample chamber in the bit which communicates with said first cavity section, said first cavity section comprising a part of said cavity and being sealed from a remainder of said cavity, said inlet opening or openings being substantially radially opposite the sample chamber said sample chamber, comprising probes for measuring the sample in situ in the sample chamber;

b) analyzing the sample in situ in the sample chamber in a first analyzing using said probes;

c) pumping the sample to a ground surface and analyzing the sample in a second analysis; and d) comparing the first and second analyses and correcting any deviations in the second analysis.

2. A method as claimed in claim 1, further comprising filtering the sample entering said first cavity section before it passes to the sample chamber.

3. A method as claimed in claim 2 wherein the sample chamber is detachably mounted in the drill string with the first cavity section positioned around the sample chamber and sealed from the remainder of the chamber, said method further comprising removing the sample chamber from the drill string, opening the drill string by displacing the tip, lowering at least one monitoring pipe in the cavity, pulling the drill string out of the borehole and monitoring the pore gas or liquid samples from the subterranean formation by means of the monitoring pipe.

4. A method as claimed in claim 2 further comprising cleaning the inlet opening or openings in situ with the drill string extending to the subterranean formation by passing a liquid or gas through the inlet or inlets via a pipe or hose connection under pressure which exceeds a pore gas or liquid pressure in the subterranean formation.

5. A method as claimed in claim 2 wherein the first analysis includes measuring the sample for one or more parameters selected from the group consisting of electric conductivity, acidity (pH), redox potential (Eh), oxygen content, pressure and ion content, and wherein the second analysis includes measuring the sample for at least one of said one or more parameters.

6. A method as claimed in claim 5 wherein the second analysis further includes measuring said ample for organic and toxic components.

7. An apparatus for taking and analyzing level determined pore gas or liquid sample from a subterranean formation said apparatus comprising:

an auger bit with a cavity extending axially therethrough and including detachable tip for detachably closing a bottom of the cavity, said bit having wall means defining a plurality of inlet openings in a vicinity of the tip for allowing a subterranean gas or liquid sample to enter the cavity;

first means for isolating a cavity section with a sample chamber detachably mounted in the cavity opposite the inlet openings so that the cavity section is sealed from a remainder of the cavity with the sample chamber communicating with the cavity section;

probe means positioned in the sample chamber for analyzing the gas or liquid sample in situ in the sample chamber and for transmitting results of the analysis to a ground surface; and pump means for pumping the samples to the ground surface from the sample chamber with the sample chamber mounted in the cavity.

8. An apparatus as claimed in claim 7 wherein the cavity section comprises filter means for filtering a gas or liquid sample passing from the cavity section to the sample chamber.

9. An apparatus as claimed in claim 8 wherein the filter means comprises sand.

10. An apparatus as claimed in claim 8 wherein the inlet openings comprise vertical slots.

11. An apparatus as claimed in claim 7 wherein the auger bit is part of a drill string and wherein the first means comprises an elastomeric sleeve for fixing around the sample chamber or an extension of the sample chamber and hose means for inflating the elastomeric sleeve so that the sleeve can be stretched tightly against an inner side of the drill string, said cavity having a constriction which begins immediately above an upper part of the elastomeric sleeve when the sleeve is inflated.

12. An apparatus as claimed in claim 7 wherein the sample chamber is mounted in a constriction in the cavity, the cavity having a diameter at the constriction which corresponds to a diameter of the sample chamber, said first means including at least one gasket which is positioned in a groove in an inner wall of the drill string and seals the cavity section from the remainder of the cavity, said apparatus further comprising swing pawl means for axially locking the sample chamber in the drill string, said swing pawl means comprising a swing pawl which engages a notch or a recess in the inner wall of the drill string.

13. An apparatus as claimed in claim 12 wherein said apparatus comprises a pump chamber connected with the sample chamber via a non-return valve which permits the gas or liquid sample to pass from the sample chamber to the pump chamber but not vice versa, said pump chamber being connected with the ground surface by means of a plurality of hose or pipe connections, said plurality of hose or pipe connections comprising a first connection through which a gas can be pumped under pressure into the pump chamber, and a second connection for conveying displaced pore gas or liquid from the pump chamber to the ground surface.

14. An apparatus as claimed in claim 7 wherein the sample chamber is connected with the ground surface by means of a pipe or hose, said pipe or hose comprising valve means for preventing passage of pore gas or liquid samples through the pipe or hose, said pipe or hose being connected, via a first valve at the ground surface with source means for feeding liquid or gas to the sample chamber under pressure which exceeds any pressure exerted by the pore gas or liquid sample entering the sample chamber from the subterranean formation.

15. An apparatus as claimed in claim 11 wherein the auger bit can be removably positioned in or out of a borehole, said apparatus further comprising monitoring pipe means for monitoring pore gas or liquid in a selected subterranean formation layer, said monitoring pipe means comprising at least one monitoring pipe which can be lowered through the cavity of the drill string when the auger bit is removed from the borehole.

* * * * *